US009255410B2

(12) United States Patent
Hamlin, III

(10) Patent No.: US 9,255,410 B2
(45) Date of Patent: Feb. 9, 2016

(54) RAISED ROOF EDGE TO SEAL AND PROTECT MEMBRANE AND ELIMINATE THE NEED FOR GUTTERS

(71) Applicant: Henry Lee Hamlin, III, Forsyth, GA (US)

(72) Inventor: Henry Lee Hamlin, III, Forsyth, GA (US)

( * ) Notice: Subject to any disclaimer, the term of this patent is extended or adjusted under 35 U.S.C. 154(b) by 0 days.

(21) Appl. No.: 13/999,942

(22) Filed: Apr. 7, 2014

(65) Prior Publication Data

US 2014/0325919 A1 Nov. 6, 2014

(51) Int. Cl.
*E04D 13/04* (2006.01)
*E04D 13/00* (2006.01)

(52) U.S. Cl.
CPC ..... *E04D 13/0445* (2013.01); *E04D 13/00* (2013.01); *E04D 13/0481* (2013.01); *E04D 2013/045* (2013.01)

(58) Field of Classification Search
CPC ..... E04D 13/04; E04D 13/14; E04D 13/1407; E04D 13/0445; E04D 13/0481; E04D 13/00; E04D 2013/045
USPC ..... 52/2.13, 2.22, 2.24, 11, 15, 16, 58, 52/302.1; 285/42
See application file for complete search history.

(56) References Cited

U.S. PATENT DOCUMENTS

| | | | | |
|---|---|---|---|---|
| 3,807,100 | A * | 4/1974 | Kuss | E04B 1/24 52/2.11 |
| 5,746,027 | A * | 5/1998 | Bonerb | E04D 13/106 52/1 |
| 6,668,491 | B1 * | 12/2003 | Bonerb | E04D 13/076 52/1 |
| 2011/0240140 | A1 * | 10/2011 | McDonald | E04B 9/00 137/312 |
| 2012/0210651 | A1 * | 8/2012 | Hamlin, III | E04D 13/0481 52/2.25 |

* cited by examiner

*Primary Examiner* — Brian Glessner
*Assistant Examiner* — Adam Barlow
(74) *Attorney, Agent, or Firm* — Harry I. Leon; Vivian L. Steadman

(57) ABSTRACT

A lightweight, raised roof edge segmented to accommodate narrow openings for scupper-fed downspouts. The edge's segments include at least one pair of elongated, inflatable or otherwise fillable, membrane-covered barriers, each of which spans about 20 feet, making it compatible with typical spacings between industrial building downspouts. Retrofitted onto a flat or low pitch roof at the latter's joint with an exterior wall, the barrier, still in its flattened state, is secured and sealed not only to the roof but also to the wall. So secured, the barrier straddles the joint between them longitudinally. Subsequently filled with gas or solids, the barrier functions as a check dam, collecting and temporarily storing storm water and/or funneling it, via scupper, into a downspout. Barriers with rigid, longitudinally extending, angular peaks also tend to break up and lift high winds, further reducing potential roof damage.

2 Claims, 3 Drawing Sheets

RAISED ROOF EDGE TO SEAL AND PROTECT MEMBRANE AND ELIMINATE THE NEED FOR GUTTERS

CROSS REFERENCE TO RELATED APPLICATIONS

This application is a continuation-in-part application of pending U.S. patent application Ser. No. 13/385,400, filed Feb. 17, 2012, and Ser. No. 13/987,485, filed Jul. 30, 2013. This application is also a non-provisional application of the earlier filed provisional applications, Ser. No. 61/854,766, filed May 1, 2013, and Ser. No. 61/967,322, filed Mar. 17, 2014, and claims the benefit of the filing dates of May 1, 2013, and Mar. 17, 2014, respectively, pursuant to 35 U.S.C. Sec. 119(e).

FIELD OF THE INVENTION

The present invention relates to a method and system for reducing the degradation of flat or low-pitch roofs as a result of their exposure to the wind and rain and, more particularly, to such a system having an array of raised, membrane-covered barriers which, depending upon where they are mounted on a building relative to the outer periphery of its roof, redirect flows of storm water across it and/or displace high winds upwardly from the roof's windward side.

BACKGROUND OF THE INVENTION

In flat roof structures such as those which are commonly used on industrial buildings, problems arise when water leaks between the roof's surface and the building's interior walls. Not only does such leakage damage the building and its roof structurally, but also it can damage materials stored in the building's interior.

One remedy is to deploy air- or foam-filled, membrane-covered barriers, such as those taught in my pending U.S. patent application Ser. Nos. 13/385,400 and 13/987,485, in such a way that said barriers direct storm water towards the building's downspouts, as well as prevent it from gaining access to any of a roof's naturally-occurring recessed areas. Unfortunately, when gutters are used to collect storm water and then feed it into the downspouts, additional problems emerge. Typically, gutters clog easily and require constant maintenance.

Moreover, high winds can cause the roof membrane to rip, especially at its juncture with a building's walls. As is well known, high winds give rise to vertical forces which tend to lift the membrane off of a building's roof. Such forces occur at the roof's windward edge whenever an air flow across it collides with an upward flow of air formed as a horizontal air flow strikes the building's upwind side and is then redirected upwardly.

Also contributing to roof membrane failure is the fact that critical fasteners at the roof deck/exterior building wall joint are continually stressed by discordant movements between the roof deck, as it expands and contracts mostly horizontally, and the wall, which expands and contracts mostly vertically. Indeed, Kelly, in U.S. Pat. No. 6,006,482, teaches that it is the destabilization of these fasteners, when they are used to secure the roof membrane in place, which ultimately leads to roof failure.

However, rather than seeking remedies whereby roof membrane failure in general can be virtually eliminated, Kelly directs his focus elsewhere. Specifically, he concentrates on improvements which can be used to reduce the extent to which a roof is catastrophically removed during a blow-off. Towards such an end, he teaches that those fasteners otherwise utilized to secure the main roof membrane proximate with the upwind side of the roof deck's outer edge must be repositioned and calls for them to be separated from said outer edge by a wide span, the width of which is such that those portions of the roof's upwind side deemed most susceptible to blow-off lie within it. Furthermore, the main roof membrane, no longer attached to these most susceptible portions is to be simply loose laid across them; and a perimeter membrane, separately attached, is to provide weather proofing in its stead. Even the roof covering's substrate is to be reconfigured so as to accommodate a groove-like "interruption". Disposed inwardly with respect to said most susceptible portions and extending both longitudinally and generally parallel to the outer edge of the roof's upwind side, each such "interruption" is provided to insure that, in the event of a roof blow-off, a relatively clean break occurs.

Nevertheless, the lack of any raised, membrane-covered barriers or the like to mitigate the impacts of storm water and/or wind on roof membranes suggests that, in prior art roof assemblies such as Kelly's, much has been missed that could have been utilized to substantially reduce the incidence of roof failure whether due to blow-off or otherwise.

SUMMARY OF THE INVENTION

In order to provide advantages such as the elimination of water leakage between a building's roof and its interior walls, the redirection of storm water flow towards a roof's scupper-fed, as opposed to gutter-fed, downspouts, and a reduction in wind loads on a roof membrane at its juncture with a roof's windward edge, a wraparound attachment is effected in which an elongated, compressed air- or solids-fillable, membrane-covered cap is secured and sealed both on top of the roof proximate with one of its outer edges and to an exterior wall which extends downwardly therefrom, with the cap thus secured extending longitudinally along the roof's outer edge and generally straddling it.

The elongated cap itself comprises a pair of long and narrow, sheet-like, thermoplastic membranes which are heat welded together along the outer periphery of the upper member of this pair except at its terminal ends. There both the upper and lower membranes are preferably joined to a pair of heat weldable, gusset-like end panels or plugs, each of which, in the assembled cap, is spaced apart from the other by roughly the length of the elongated cap.

In the case of each such cap which is to be inflated with compressed air or nitrogen, the upper membrane is also equipped with an air or gas filling valve attached thereto by a clamping mechanism which creates an airtight seal between the valve and the membrane. Likewise, each of the heat welded joints between the upper and lower membranes, as well as between each of them and the gusset-like end panels, is to be part of a continuous loop that forms an airtight seal wherever such a joint exists in the individual inflatable cap. With the joints so sealed, the latter defines an airtight member capable of maintaining itself in an inflated state for a significant length of time once it has been filled with compressed air or nitrogen using said valve.

On the other hand, for those elongated caps which are to be filled with non-gaseous materials such as preformed solid particulates or spray foam-generating chemical agents, each of the heat welded joints between the upper and lower membranes, as well as between each of them and the gusset-like end panels, needs only to form a watertight seal. With its joints so sealed, the individual solids-fillable cap defines a watertight pocket. The latter, accessible through a filling port such as a short slot cut in the cap's upper membrane, can be filled with the use of a wand-like, tubular injector. Once the pocket is full, its watertightness can then be restored by heat welding or otherwise affixing a suitable patch to the upper membrane so as to close off the slot and form a watertight seal about it. A transverse cross-section of such a filling port in the form of a short slot cut in the upper membrane of a barrier fabricated by heat welding two membranes together so as to define a watertight pocket, which is then filled with spray foam-generating chemical agents, the short slot so cut being closed with a watertight patch and seal once said agents have reacted to create a solidified mass within the pocket, is shown in FIG. 6 of my pending U.S. patent application Ser. No. 13/987,485.

For both the gas-fillable and solids-fillable embodiments of the elongated cap, the wraparound attachment is accomplished by first securing the cap, in its unfilled state, generally astraddle the roof's outer edge. So secured, the cap is preferably held in place by mechanical fasteners including first and second termination bars which are mounted generally parallel to the roof's outer edge and affixed, respectively, to the roof deck and to the building's exterior wall downwardly of the roof/wall joint. Not only juxtaposed between the first termination bar and the roof deck but also pressed therebetween are portions of the upper and lower membranes. The latter portions extend laterally from one of two longitudinally extending, heat welded joints which bound the cap's airtight member or, alternately, watertight pocket and are disposed outwardly of it. Likewise, portions of the upper and lower membranes which extend laterally from the second of said longitudinally extending joints and are disposed outwardly of the airtight member/watertight pocket are not only juxtaposed between the second termination bar and the building's exterior wall but also pressed therebetween.

In use, each elongated cap, suitably filled with either gas or solids depending upon the design features it embodies, is deployed as one of an array of such caps which extend longitudinally, generally end-to-end but with a narrow spacing between each adjoining pair of caps so that storm water flowing across the roof can gain access to the building's downspouts via scuppers, the mouths of which are mounted contiguous with the roof's outer edge. Moreover, the adjoining caps' gusset-like end panels which are situated on either side of said narrow spacing abut opposing side walls of the scupper's mouth but diverge in a direction away from it, so that storm water from the roof can be funneled directly into the scupper. In addition, the raised profile of each filled cap in the array, strategically positioned as it is along the roof's outer edge, allows it to function as a check dam to collect and temporarily store storm water and then release it into the scupper, thus, when the storage capacity of said check dam is adequate, eliminating the need for a roof gutter.

Elongated, gas- or solids-filled caps can also be mounted either singly or in multiples inwardly of a low pitch roof's lower outer edges and generally parallel thereto. So mounted, these caps function as additional check dams to augment the storm water storage capacity of the caps arrayed contiguous with such an outer edge. In general, the storage capacity of the elongated caps variously deployed on a roof should be based on anticipated rainfall patterns in a given locale.

On the other hand, in those situations in which it is desirable to expedite the removal of storm water from a roof, three-sided, dome shaped crickets, in combination with an array of elongated, filled caps mounted generally astraddle the roof's outer edge, can be deployed. Like the caps, each of the crickets comprises a pair of upper and lower sheet-like membranes which are heat welded together along the outer periphery of at least one of them to form an airtight member which can be inflated through an air- or gas-filling valve attached to the upper membrane or, alternately, a watertight pocket which can be filled with non-gaseous materials through a filling port such as a short slot cut in the cricket's upper membrane and then, once the cricket has been suitably filled, covered with a watertight seal.

In the preferred embodiment, each such cricket is so configured that, when mounted on the roof inwardly of its outer edge but contiguous with those parts of an elongated, filled cap in said array which, pressed against the roof, are juxtaposed between it and a first termination bar, two of the cricket's sides can be aligned generally in parallel with the cap's gusset-like end panels and converge roughly where these two end panels would converge if they, too, were extended far enough inwardly of the roof's outer edge. Moreover, a combination in which one side of such a three-sided cricket is mounted contiguous with said parts of each elongated, filled cap and in which the other two sides of the cricket are so aligned with the cap's two end panels can be deployed in multiple units to form funnel-like barriers which together span a low-pitch roof and divert storm water into scuppers mounted contiguous with its lower outer edge.

Further, for the purpose of causing high winds to detach from the elongated, filled caps deployed along a roof's windward side so that downwind of the caps, the winds break up, forming eddies rather than creating strong uplift forces capable of destroying the roof's membrane, each cap preferably defines a longitudinally-extending peak. Such caps capable of holding, an angular, raised profile include those, with upwardly-oriented, generally triangularly-shaped end panels, into which spray foam-generating chemical agents are injected, one layer at a time, until a solidified mass of spray foam, which is generally triangular in transverse cross-section, has been built up.

DETAILED DESCRIPTION OF THE PREFERRED EMBODIMENTS

Figure 1:
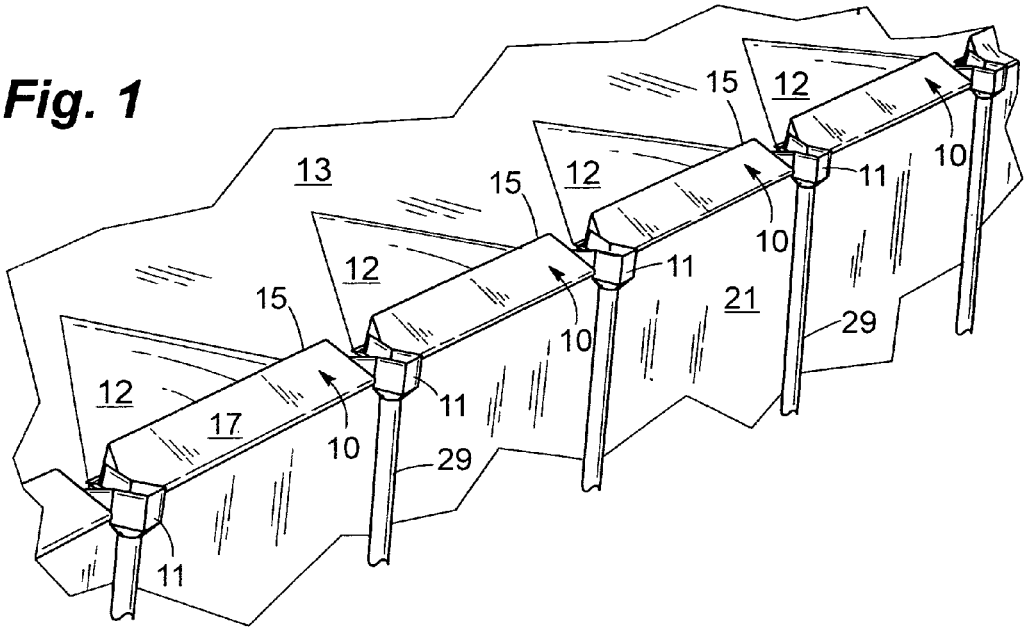
FIG. 1 is a perspective view of an array of elongated, filled caps according to the present invention, the caps, in combination with triangularly-shaped crickets; being shown mounted along a low-pitch roof's outer edge, with each of the caps secured both to the roof deck and to the upper end of an exterior wall at the roof/wall joint.

In the drawings, a raised roof edge segmented to accommodate narrow openings for scupper-fed downspouts 29 is shown. The edge's segments include at least one pair of elongated, inflatable or otherwise fillable, membrane-covered barriers. Those indicated generally by the reference numeral 10 are capable of holding a raised profile with a longitudinally-extending peak 15 (FIGS. 1-3).

Prior to the barrier or cap 10 assuming such a raised profile, or even being secured in place to function as one segment of a raised roof edge, the cap's skin is preferably assembled off-site and tailored not only to fit the spacing between pairs of downspouts 29 but also to provide means for attaching the skin, while it is still in an unfilled state, along the outer edge 50 of a generally flat or low-pitch roof 13. Properly attached along the outer edge, the cap 10 generally straddles it longitudinally and forms a continuous watertight seal, proximate with the outer periphery of the cap's underside, between it and contiguous surfaces on the roof and on the upper end of an exterior wall 21 joined thereto. Furthermore, the distal ends of the skin of each cap 10 are preferably sized and shaped so that they are consistent with the generally angular transverse cross-section which the cap has in its raised profile.

Figure 2:
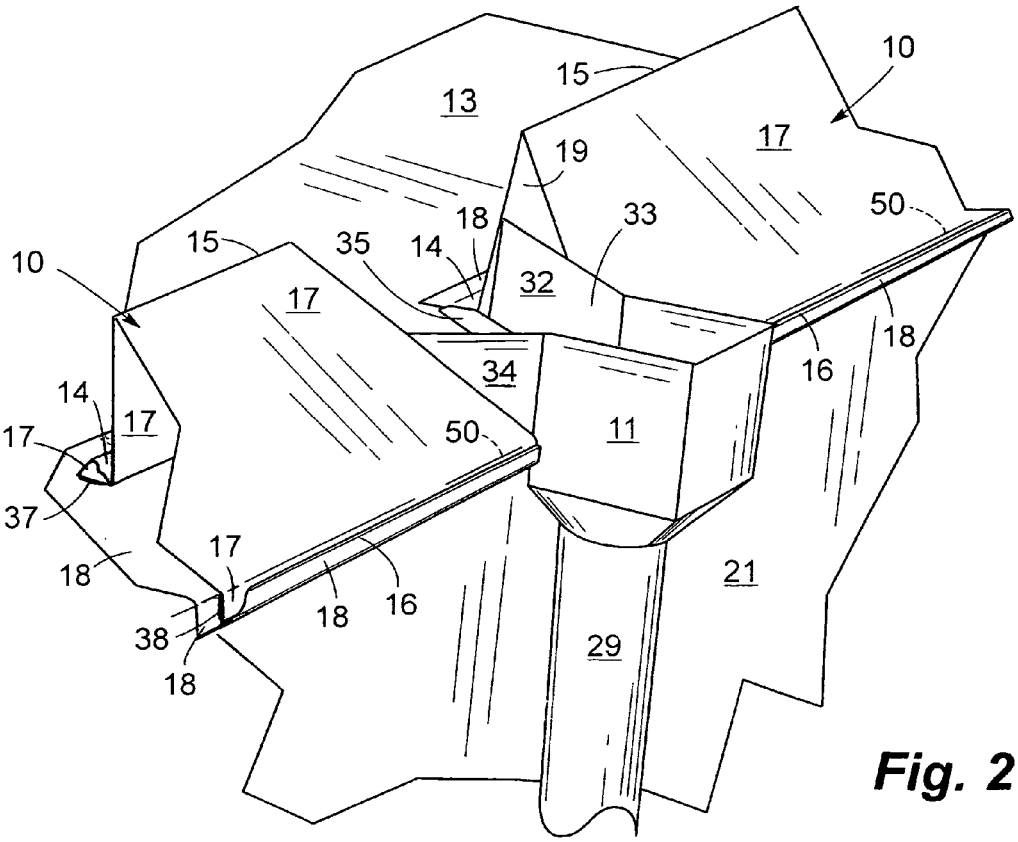
FIG. 2 is a perspective view, on an enlarged scale, of fragmentary end portions of a pair of adjoining elongated, filled caps according to FIG. 1, but with the crickets depicted therein omitted for ease of illustration, as are non-gaseous materials with which the elongated caps are filled during use, the caps being shown narrowly spaced apart from each other and in abutment, along their respective triangularly-shaped end panels, with a pair of vertical diverters which are fixedly attached, funnel-like, to a scupper's opposing side walls at its mouth.
Figure 3:
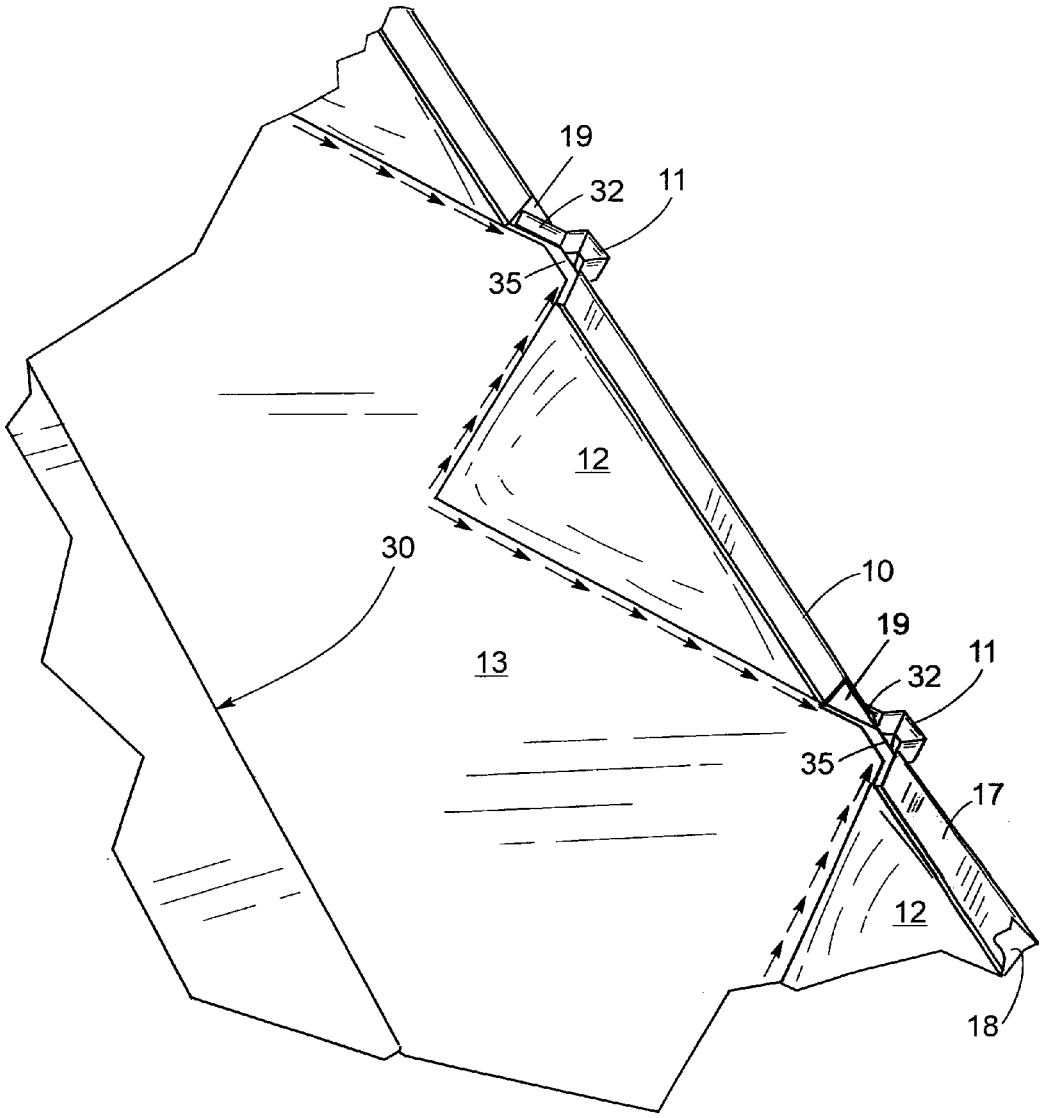
FIG. 3 is a top perspective view of a fragmentary portion of the array of elongated, filled caps, in combination with triangularly-shaped crickets, according to FIG. 1, with one such cap in the array being shown stretched out longitudinally between two scuppers and with one of the latter depicted as having a fragment of a diverter attached thereto such that one of the triangularly-shaped end panels of the cap so stretched out is fully exposed to view, and wherein arrows have been added to show the direction of downward slopes along those sides of each pair of adjoining crickets which converge in the direction of a common scupper's mouth juxtaposed between adjoining caps with which the crickets are individually paired.

As illustrated in FIGS. 1-3, the cap 10 includes upper and lower membranes 17, 18 and generally triangularly-shaped end panels 19. Sheet-like and fabricated of a thermoplastic material, the membranes 17, 18 are affixed to each other along first and second spaced apart, longitudinally extending, heat welded joints 37, 38 except at interfaces between the upper membrane 17 and each of the end panels 19 and between the lower membrane 18 and said end panels (FIG. 2). The end panels 19 themselves, also fabricated of a heat weldable material, are likewise so affixed along their respective edges to the upper and lower membranes 17, 18 at said interfaces. With each of the heat welded joints between the upper and lower membranes 17, 18 as well as between them and contiguous edges of the end panels 19, forming a watertight seal, the cap's skin defines a watertight pocket.

By so affixing the end panels 19 to the membranes 17, 18, one effectively sizes and shapes the distal ends of the skin of the cap 10 for consistency with the generally triangular transverse cross-section for which the cap, in its raised profile, is designed. Also, by generally orienting the cap's distal end panels 19 so that, along their respective heat welded joints with the lower membrane 18, each of them intersects the first longitudinally extending joint 37 between the membranes 17 and 18 at an obtuse angle, one can form a skin for the cap 10, which gives it a generally trapezoidally-shaped base in which said obtuse angles are present as two of its four interior angles. Moreover, this base is one from which generally triangularly-shaped end panels extend upwardly (FIG. 3).

By taking advantage of the fact that the unfilled cap 10 generally retains the flexibility of the sheet-like membranes 17, 18 from which it is largely constructed, one can secure the cap so that it overlaps the roof's outer edge 50 and generally straddles it longitudinally. So secured, the cap 10 is preferably held in place by mechanical fasteners including first and second termination bars which, mounted generally parallel to the roof's outer edge 50, are affixed, respectively, to the roof deck and to the exterior wall 21 downwardly of the roof/wall joint and housed within watertight encasements 14, 16 (FIG. 2). An embodiment of such mechanical fasteners is disclosed in my pending U.S. patent application Ser. No. 13/987,485. Identified therein as elongated, galvanized plates are termination bars that are affixed, with the use of screws, to a roof deck and, in the process, secure a foam-filled, membrane-covered barrier, alone its outer periphery in place.

Not only juxtaposed between the first termination bar and the roof deck but also pressed therebetween are portions of the upper and lower membranes 17, 18, which extend laterally from the first longitudinally extending joint 37 and are disposed outwardly of it. Likewise, portions of the membranes 17, 18 which extend laterally from the second longitudinally extending joint 38 are not only juxtaposed between the second termination bar and the exterior wall 21 but also pressed therebetween (FIG. 2).

The encasement 14 itself is preferably formed by folding a flap of the upper membrane 17 back and over the first termination bar and securing the flap in place in such a way that a watertight seal is made about the bar. Similarly, the encasement 16 is formed by folding a flap of the lower membrane 18 up and over the second termination bar, prior to creating a watertight seal about it. Each of the flaps employed to forming the encasements 14, 16 is an otherwise unused extension of a laterally extending portion of the membrane 17, 18 which, instead of being pressed against the roof deck or exterior wall, respectively, remained free of the termination bar.

Each cap 10, suitably filled with a solidified mass of spray foam or the like, can then be deployed as one of an array of such caps which extend longitudinally, generally end-to-end but with a narrow spacing between each adjoining pair of caps. It is through this narrow spacing that storm water flowing across the roof 13 can gain access to a downspout 29 fed by a scupper 11 contiguous with the roof's outer edge. Moreover, the adjoining caps' generally triangularly-shaped end panels 19 which are situated on either side of said narrow spacing abut opposing vertical diverters 32, 34 fixedly attached to the scupper's side walls but diverge in a direction away from the scupper. Thus, storm water, immediately after it crosses a connection flange 35 protecting the roof membrane at the scupper's mouth, can be funneled directly into it (FIG. 2). Downspouts 29 and scuppers 11, when fabricated of plastic, are preferably heat welded together to form watertight joints; and made of metal, they are mechanically fastened together to insure watertightness.

In addition, the raised profile of each filled cap 10 in the array, strategically positioned as it is along the roof's outer edge, allows it to function as a check dam to collect and temporarily store storm water and then release it.

Moreover, additional caps 10, mounted inwardly of a low pitch roof's lower outer edges and generally parallel thereto, can also be used as check dams to augment, temporarily, the storm water storage capacity of the caps arrayed contiguous with such an outer edge.

To expedite storm water removal from a roof 13, three-sided, dome shaped crickets 12, in combination with an array of caps 10 mounted generally astraddle the roof's outer edge, can be deployed. As described in my pending U.S. patent application Ser. Nos. 13/385,400 and 13/987,485, each such cricket 12 can be constructed from a pair of upper and lower sheet-like membranes heat welded together along the outer periphery of at least one of them. The cricket 12, once it has been fixedly attached along its side edges to the roof deck and sealed to the roof membrane, is then either inflated through an air- or gas-filling valve attached to its upper membrane or filled with non-gaseous materials, such as spray foam-generating chemical agents, through a filling port such as a short slot cut in the assembled cricket's upper membrane and subsequently covered with a watertight patch and seal.

Preferably, each cricket 12 is so configured that, when mounted on the roof 13 contiguous with those parts of a filled cap 10 which are pressed against the roof by the first termination bar, the cricket can be oriented in such a way that two of its sides are aligned generally in parallel with the cap's end panels 19 and converge roughly where these two end panels would converge if they were to be extended inwardly of the roof's outer edge. By mounting one side of such a three-sided cricket contiguous with said parts of each filled cap 12, a segmented raised roof edge can be formed which funnels storm water, captured across wide expanses of a low pitch roof 13 between its ridgeline 30 and outer edge, into the scuppers 11 (FIGS. 1 and 3).

The cap 10, once its skin is intact and forms a watertight pocket, is preferably built up by injecting spray-foam generating chemical agents, one layer at a time, into the pocket, through a short slot cut in the upper membrane 17. This injection process, accompanied by the use of plywood sheets or the like strategically placed to mold generally planar surfaces extending longitudinally between the cap's generally triangularly shaped end panels 19, is continued until the pocket is substantially filled and occupied by a solidified mass of spray foam having an angular, raised profile consistent with that of the end panels. Subsequently, the short slot filling port is covered and sealed with a watertight patch.

In addition, caps which are generally trapezoidally-shaped in transverse cross-section across their respective raised profiles can be arrayed, like the caps 10, to form a segmented raised roof edge. They, too, protect the roof membrane by sealing its ends so as to stop water from leaking under them and between a building's exterior walls and its interior, by displacing high winds upwardly so that they are less capable of ripping the roof membrane and/or lifting it off of the roof deck, and by temporarily holding the storm water on the roof 13 until it can be funneled towards scuppers 11 and then fed into downspouts 29.

Figure 4:
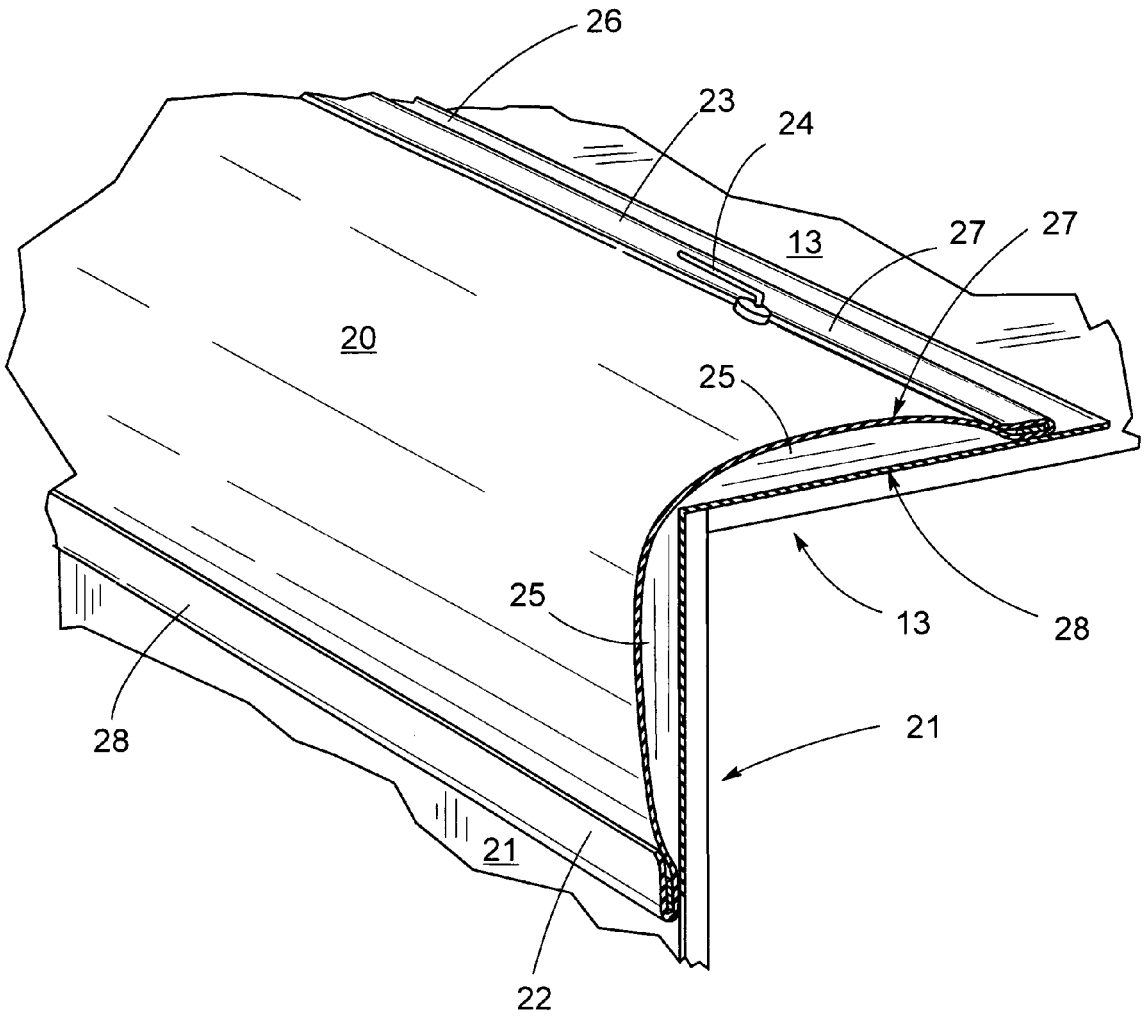
FIG. 4 is a perspective view, which includes a transverse cross-section also in perspective, of a fragmentary portion of an alternate embodiment of the elongated, filled cap according to the present invention, the cap, which is inflatable, being shown mounted astraddle a roof's outer edge and secured both to the roof deck and to an exterior wall downwardly of the roof/wall joint.

As illustrated in FIG. 4, an alternate embodiment in the form of an inflatable cap 20 can also function as one segment of a raised roof edge. Unlike its angular counterparts, which are solids filled, the cap 20, with its gaseous filling, not only can be secured and sealed to a building on both sides of the roof/wall joint but also that portion of the cap wrapped over this joint can be extended downwardly from it a substantial distance.

The cap 20 itself includes a pair of long and narrow, sheet-like thermoplastic membranes 27, 28 which are heat welded together along the outer periphery of the upper member 27 except at its terminal ends. So heat welded together, the membranes 27, 28 define first and second spaced apart, longitudinally extending joints which, at their respective distal ends are intersected by rounded, gusset-like end panels (not shown), each of which has a curvilinearally-shaped upper edge and base edges which intersect perpendicularly to accommodate surfaces at the roof/wall joint. Each of these rounded end panels, also fabricated of a heat weldable material, is also affixed, by heat welding techniques, along their respective edges to the lower and upper membranes 28, 27 wherever the panel edges abut them.

Outfitted with a charging valve 24 which is attached to the upper membrane 27, prior to its being heat welded to the lower membrane 28, so as to form an airtight seal between the valve and the membrane contiguous with it, the cap 20, once its assembled skin forms an airtight member 25, is then ready to be secured, but still in its unfilled state, astraddle the roof's outer edge. So secured, the cap is preferably held in place by first and second termination bars which, housed in watertight encasements 23 and 22, are mounted generally parallel to the roof's outer edge and affixed, respectively, to the roof deck and to the building's exterior wall downwardly of the roof/wall joint. The first termination bar, as it so holds the cap in place, presses portions of the upper and lower membranes 27, 28 which extend laterally from the first longitudinally extending joint between itself and the roof deck. Likewise, the second termination bar presses portions of these membranes which extend laterally from the second longitudinally joint against the wall 21.

The encasement 23, which provides protection for the first termination bar, is preferably formed by folding a flap of the upper membrane 27 back and over said bar (FIG. 4). A flap 26 of the lower membrane 28 then remains contiguous with the roof 13 and is sealed to form a watertight barrier with the roof membrane. The encasement 22 for the second termination bar, on the other hand, is formed by folding a flap of the lower membrane 28 up and over the latter bar, forming a watertight seal in the process.

The invention claimed is:

1. An elongated, membrane-covered cap adapted to be mounted on a building having a generally flat or low-pitch roof and proximate with upper ends of a pair of spaced apart downspouts which extend vertically along one of the building's exterior walls and are disposed downwardly of the roof's outer edge and its joint with the wall, which comprises:

(a) a skin which includes upper and lower sheet-like, thermoplastic membranes and a pair of generally angularly-shaped end panels fabricated of a heat weldable material, each of the end panels being individually bounded by at least three edges which together form its perimeter, each of the upper and lower membranes individually defining a pair of first and second spaced apart, longitudinally extending peripheral edges in which, prior to the skin's assembly, spacing between the upper membrane's first and second peripheral edges is substantially greater than that between the lower membrane's first and second peripheral edges, wherein, in assembled relation with the angularly-shaped end panels, the upper and lower membranes are affixed to each other by heat welding along their respective first longitudinally extending peripheral edges as well as along their respective second longitudinally extending peripheral edges, and wherein the angularly-shaped end panels are likewise affixed by heat welding along their respective perimeter-forming edges to the upper and lower membranes with only one such perimeter-forming edge of each end panel be so affixed to the lower membrane and with each end panel's perimeter-forming edges other than said edge affixed to the lower membrane being so affixed to only the upper membrane, each juncture wherever the upper and lower membranes are affixed to each other by heat welding, as well as each juncture wherever said membranes and the perimeter-forming edges of the end panels are so affixed, forming a watertight seal in such a way that the skin defines a watertight enclosure;

(b) means, including a filling port which penetrates the upper membrane and which can be tightly closed against passage of water, for introducing non-gaseous fill material into the enclosure;

(c) wherein the skin, once it has been stretched out longitudinally, mounted astraddle the joint between the roof's outer edge and said exterior wall with the first and second longitudinally extending peripheral edges disposed generally parallel with said joint, and filled to substantially the watertight enclosure's full capacity, has a raised profile with an elongated, generally trapezoidally-shaped base which is disposed contiguous with the roof and from which, at the base's distal ends, the end panels extend upwardly, with spacing between them increasing in the direction of the joint between the roof's outer edge and said exterior wall until the skin so stretched out, where it crosses the roof's outer edge, extends across a span which in length approximates that between said pair of downspouts; and (d) wherein each such end panel is narrowly spaced apart from another such end panel when an adjoining pair of the elongated, membrane-covered caps so filled are deployed longitudinally along the roof's outer edge, thus forming a funnel-like channel through which storm water captured on the roof can be directed towards one of the downspouts.

2. An elongated, membrane-covered cap adapted to be mounted on a building having a generally flat or low-pitch roof and proximate with upper ends of a pair of spaced apart downspouts which extend vertically along one of the building's exterior walls and are disposed downwardly of the roof's outer edge and its joint with the wall, which comprises:

(a) skin which includes upper and lower sheet-like, thermoplastic membranes and a pair of end panels, each end panel being fabricated of a heat weldable material, the upper and lower membranes being affixed to each other along first and second spaced apart, longitudinally extending, heat welded joints except at interfaces between the upper membrane and each of the end panels and between the lower membrane and said end panels, the end panels being heat welded along their respective edges to the upper and lower membranes at said interfaces, each of the heat welded joints between the upper and lower membranes, as well as between said membranes and contiguous edges of the end panels, forming a seal which is impervious to water, the skin defining an enclosure;

(b) means, including a filling port which penetrates the upper membrane, for introducing fill material into the enclosure, the filling port, once it has been tightly closed, preventing passage of fill material outwardly from said enclosure through said port;

(c) wherein the skin, once it has been stretched out longitudinally, mounted astraddle the joint between the roof's outer edge and said exterior wall, and filled to substantially the enclosure's full capacity, has a raised profile with an elongated, generally trapezoidally-shaped base which is disposed contiguous with the roof and from which, at the base's distal ends, the end panels extend upwardly, with spacing between them increasing in the direction of the joint between the roof's outer edge and said exterior wall until the skin so stretched out, where it crosses the roof's outer edge, extends across a span which in length approximates that between said pair of downspouts; and (d) wherein each such end panel is narrowly spaced apart from another such end panel when an adjoining pair of the elongated, membrane-covered caps so filled are deployed longitudinally along the roof's outer edge, thus forming a funnel-like channel through which storm water captured on the roof can be directed towards one of the downspouts.

* * * * *